US008106321B2

(12) United States Patent
Göhler et al.

(10) Patent No.: US 8,106,321 B2
(45) Date of Patent: Jan. 31, 2012

(54) DISCONNECTING SWITCH DEVICE AND METHOD FOR PRODUCTION OF A DISCONNECTING SWITCH DEVICE

(75) Inventors: Reinhard Göhler, Berlin (DE); Bernd Kruska, Berlin (DE); Kai Steinfeld, Wuxi (CN); Gernot Swiatkowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 225 days.

(21) Appl. No.: 12/530,239

(22) PCT Filed: Mar. 4, 2008

(86) PCT No.: PCT/EP2008/052589

§ 371 (c)(1),
(2), (4) Date: Sep. 14, 2009

(87) PCT Pub. No.: WO2008/107432

PCT Pub. Date: Sep. 12, 2008

(65) Prior Publication Data

US 2010/0044199 A1 Feb. 25, 2010

(30) Foreign Application Priority Data

Mar. 8, 2007 (DE) ..... 10 2007 012 296

(51) Int. Cl.
*H01H 9/02* (2006.01)

(52) U.S. Cl. ..... 200/303; 200/339

(58) Field of Classification Search ..... 200/303
See application file for complete search history.

(56) References Cited

U.S. PATENT DOCUMENTS

| | | | | |
|---|---|---|---|---|
| 2,559,024 | A | 7/1951 | McFarlin | |
| 2,757,261 | A | 7/1956 | Lingal et al. | |
| 4,296,285 | A | 10/1981 | Lang et al. | |
| 4,937,407 | A * | 6/1990 | Osika | 200/302.3 |
| 5,057,810 | A | 10/1991 | Raudabaugh | |
| 5,363,266 | A | 11/1994 | Wiseman et al. | |
| 5,699,899 | A * | 12/1997 | Kahlbau | 200/302.1 |
| 2004/0239472 | A1 | 12/2004 | Huo et al. | |

FOREIGN PATENT DOCUMENTS

| | | | |
|---|---|---|---|
| DE | 2903987 | A1 | 7/1980 |
| DE | 69322389 | T2 | 8/1999 |
| DE | 10025685 | A1 | 11/2001 |
| DE | 10209627 | A1 | 10/2003 |
| GB | 2305310 | A | 4/1997 |
| WO | 9710631 | A1 | 3/1997 |

OTHER PUBLICATIONS

German Search Report dated Nov. 6, 2007.
International Search Report dated Oct. 10, 2008.

* cited by examiner

*Primary Examiner* — Elvin G Enad
*Assistant Examiner* — Lisa Homza
(74) *Attorney, Agent, or Firm* — Laurence A. Greenberg; Werner H. Stemer; Ralph E. Locher

(57) ABSTRACT

A circuit breaker device has a first electrode piece and a second electrode piece. In order to ensure protection from weather, the circuit breaker device is equipped with an electrically isolating housing. The electrically isolating housing has a first shell and a second shell. The first shell serves as a volatile casing for the second shell during production.

11 Claims, 1 Drawing Sheet

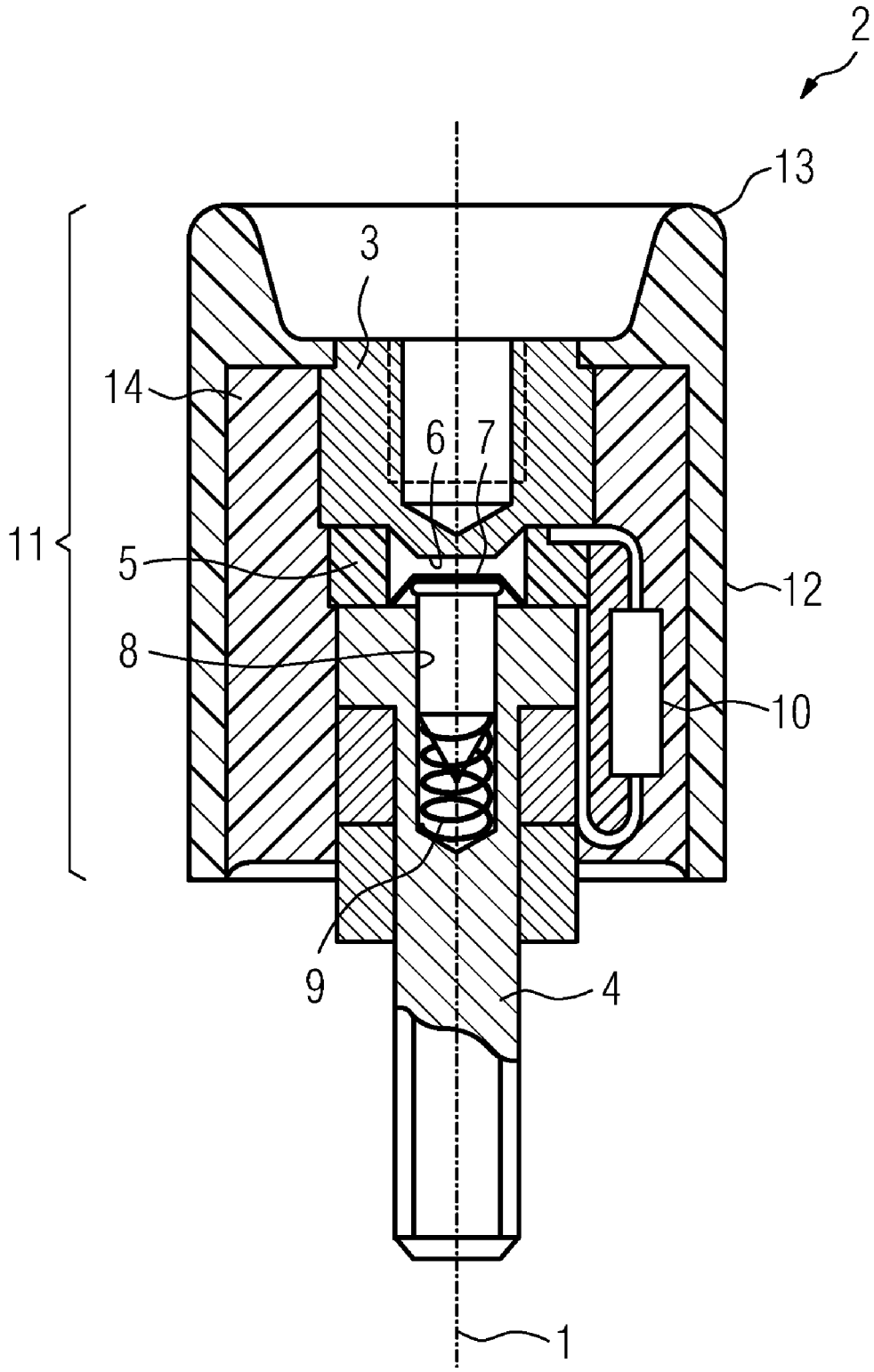
2
13
3
14
6
7
11
5
12
8
10
9
4
1

DISCONNECTING SWITCH DEVICE AND METHOD FOR PRODUCTION OF A DISCONNECTING SWITCH DEVICE

BACKGROUND OF THE INVENTION

Field of the Invention

The invention relates to a disconnecting switch device having a first electrode piece and a second electrode piece, which electrode pieces can be moved relative to one another in order to disconnect a current path and are at least partially surrounded by an electrically insulating housing, and to a method for production of a disconnecting switch device.

By way of example, a disconnecting switch device is known from the laid-open specification DE 100 25 685 A1. In the known disconnecting switch device, two electrode pieces are surrounded by an electrically insulating housing. Since disconnecting switch devices such as these are also intended for outdoor use, the electrically insulating housing must be manufactured from weather-resistant material. However, materials showing good electrical characteristics are often unsuitable for outdoor use.

BRIEF SUMMARY OF THE INVENTION

An object of the invention is therefore to specify a disconnecting switch device of the type mentioned initially which has good weather resistance.

In the case of a disconnecting switch device of the type mentioned initially, the object is achieved according to the invention in that the housing has a first and a second shell, with the first shell sheathing the second shell and protecting it against external influences.

When using a two-shell housing, the first shell may be manufactured from a material which has good weather resistance. The first shell should preferably be formed from an insulating material. In particular, the first shell should be highly resistant to ultraviolet radiation and weathering. A material for the second shell can preferably be chosen on the basis of its electrical characteristics. For example, it is possible to use low-cost insulating materials. The volume of the first shell should advantageously be less than the volume of the second shell. The housing surrounds the two electrode pieces at least in the section in which the electrode pieces face one another. Disconnecting switch devices are also referred to as arrester disconnectors.

According to a further advantageous refinement, the first shell can be a lost shell for the second shell.

If the first shell is used as a permanent shuttering (lost shell), then the disconnecting device can easily be fitted. The layers of the individual assemblies can be fixed with respect to one another in a simple manner by means of appropriate shaping. Since the shell acts as the first shell, auxiliary devices or special tools are required only to a minor extent during assembly. The first shell, as a shell, provides the disconnecting switch device with stability until the final characteristics are reached.

It is advantageously also possible to provide for the first electrode piece to close a recess in the first shell.

By way of example, the first shell may be in the form of a hollow body with at least one recess. A rotationally symmetrical shape in the form of a cup is advantageous, with the recess advantageously being arranged in a base of the cup. By closing the recess with the first electrode piece, it is possible to gain access to the first electrode piece through the electrically insulating housing. The disconnecting switch device with the first electrode piece can then be included, for example, in a dissipation current path controlled by a surge arrester. Insertion of the first electrode piece with a complementary shape into the recess makes it possible to fix the relative position of the first shell with respect to the first electrode piece.

Furthermore, according to one advantageous refinement, the recess can be surrounded by a projecting attachment on the first shell.

The projecting attachment can protect that area of the first electrode piece which is accessible through the recess against external influences. The attachment may be in the form of a closed ring, for this purpose. Furthermore, a contact-making point in the area of the recess can be protected by the attachment. For example, this makes it possible for the disconnecting switch device to be screwed to a threaded bolt or into a threaded hole by means of the first electrode piece in the area of the recess in the first shell. The projecting attachment can act as a stop, and can delimit the screwing-in depth. Assuming adequate elasticity, a sealing effect can also be achieved by means of the attachment.

Furthermore, it is advantageous for the first electrode piece and the second electrode piece to be aligned coaxially with respect to a longitudinal axis of the disconnecting switch device, with a first end of the first electrode piece being adjacent to the first shell, and with a second end of the second electrode piece being adjacent to the second shell, with respect to the longitudinal axis.

Since the second electrode piece is arranged at a distance from the first shell above the second shell, an isolation gap can be ensured between the electrode pieces even when using an electrical conductor material for the first shell. The second shell is formed like a type of cap, which merges flush with the first electrode piece and is separated from the second electrode piece in an electrically isolated manner by the second shell. The electrode pieces may preferably be in the form of rotationally symmetrical bodies.

It is advantageously also possible to provide for the current path to have an arc gap.

An arc gap may be arranged between the electrode pieces. By way of example, the arc gap can be bridged by an impedance element. The response of the arc gap can be controlled by the impedance element, which is preferably of a resistive nature. When current is flowing through the current path, an arc can be formed in the arc gap. The thermal energy of the arc can be used in order to trip the disconnecting switch device and to interrupt the current path. After interruption, the distance between the electrode pieces is sufficiently great that the arc is quenched, and does not restrike.

According to a further advantageous refinement, the second shell may be formed from a polyurethane. Polyurethanes have an adequate dielectric strength and can be obtained at low cost. Polyurethanes may, for example, be introduced into the first shell in a liquid or highly viscous form, and can be cured there. A two-shell, electrically insulating housing is thus formed which prevents the formation of undesirable parallel current paths between the electrode pieces. In this case, the first shell makes contact at most with one of the two electrode pieces. The second shell may make contact with both electrode pieces. The second shell surrounds and bridges the arc gap in an electrically isolating manner.

If the first shell is in the form of a cup, inner walls are covered by the second shell, except for areas in which a recess is arranged. The second shell can therefore merge flush both with the electrode pieces and with the first shell, and can thus form a moisture-tight assembly. The second shell can preferably form an adhesive joint between the first shell and the electrode pieces.

It is advantageously also possible to provide for the first shell to be formed from a UV-stable insulating material.

The use of insulating material for forming the first shell assists the electrically isolating effect of the second shell. Furthermore, when the two shells are connected by means of an integral joint, this can result in a connection with particularly good resistance. The electrode pieces and further assemblies can likewise be connected by an integral joint to the second shell. The use of insulating materials both for the first and for the second shell also ensures that the electrode pieces are protected against direct contact. Thermoplastic insulating materials often have adequate UV resistance.

A further object of the invention is to specify a method which allows a disconnecting switch device to be manufactured at low cost.

According to the invention, the object is achieved for a method for production of a disconnecting switch device in that

- a first and a second electrode piece of a disconnecting switch device are at least partially inserted into a dimensionally stable first shell, which is used as a permanent shuttering shell, of an electrically insulating housing of the disconnecting switch device,
- a second shell of the electrically insulating housing is introduced in a dimensionally flexible manner into the first shell, with the second shell being changed to a dimensionally stable body within the second shell.

The first shell can be designed to be dimensionally stable such that it can be positioned relative to the electrode pieces and can withstand the forces originating from the dimensionally flexible shell. The first shell can therefore always be elastically deformable. However, it should retain its shape without the use of any external holding and supporting apparatuses.

The dimensionally flexible second shell should have a fluid, preferably liquid or flowing consistency while being introduced into the first shell. Highly viscous substances can also be understood as being liquid for the purposes of the invention. During the introduction process, the second shell may also be in the form of a plurality of components, which react with one another within the first shell.

According to a further advantageous refinement, an impedance element, which makes electrical contact with the first electrode piece and with the second electrode piece, can be embedded in the second shell.

The electrode pieces of the disconnecting switch device are part of a current path when in the installed state. The current path may contain an arc gap. For example, the electrode pieces may be arranged at a distance from one another, with a gas being arranged in the arc gap that is formed in this way. In order to control the breakdown behavior of the gas relatively accurately, an impedance element can bridge the arc gap. In order to avoid external influencing of the impedance element, it should be arranged at a distance from the first shell. In order to prevent direct contact with the first shell, parts of the second shell should extend between the impedance element and the first shell. This results in the impedance element being held in a dielectrically safe manner irrespective of the choice of material for the first shell. The impedance element should preferably be completely sheathed by the second shell, in such a way that connecting pieces pass through the second shell in order to allow electrical contact to be made with the impedance element.

It is advantageously also possible to provide for the first electrode piece to be inserted in a sealing manner into a recess in the first shell.

Interlocking insertion of the first electrode piece into the recess seals the first shell such that the second shell can be introduced, for example in the liquid state, into the first shell. In this case, depending on the expected viscosity of the second shell, it is possible to use different forms of fit, such as clearance fits, interference fits, or the like. If required, it is thus possible to dispense with additional sealing elements.

By way of example, it is possible to provide a shoulder on the first electrode piece and/or on the recess, thus limiting the depth of insertion of the electrode piece into the recess. It is thus possible to produce a flush transition to the first electrode piece on a surface of the first shell.

It is advantageously also possible to make a longitudinal axis of the first electrode piece and a longitudinal axis of the first shell correspond approximately by the insertion of the first electrode piece.

The use of a fit between the first electrode piece and the first shell for position fixing allows the disconnecting switch device to be assembled quickly. An area which extends essentially in an annular shape between the first electrode piece and the first shell can be filled with the second shell. Fixing the position between the first electrode piece and the first shell ensures that an adequate volume is available on all sides for accommodation of the second shell. The longitudinal axes of the electrode pieces should preferably be axes of rotation of the electrode pieces. This also applies approximately to the shells.

BRIEF DESCRIPTION OF THE SEVERAL VIEWS OF THE DRAWING

One exemplary embodiment of the invention will be explained in more detail in the following text and is illustrated schematically in a FIGURE, in which: the FIGURE shows a section through a disconnecting switch device.

DESCRIPTION OF THE INVENTION

The section shown in the figure passes through a longitudinal axis 1, with respect to which a disconnecting switch device 2 is essentially rotationally symmetrical.

By way of example, the disconnecting switch device 2 is used for surge arresters. Surge arresters are used for voltage-dependent connection and disconnection of a current path which runs from a conductor, which is live during operation, to a ground potential. Switching is carried out, for example, by means of varistors in the surge arresters. Varistors are semiconductor elements which can fail, for example, when electrically overloaded. When a surge arrester fails, an undesirable ground fault can be formed. In order to cope with a situation such as this, a disconnecting switch device is additionally inserted in the current path.

The disconnecting switch device 2 shown in the figure has a first electrode piece 3 and a second electrode piece 4. The two electrode pieces 3, 4 are rotationally symmetrical and are arranged opposite one another, coaxially with respect to the longitudinal axis 1. An annular electrically insulating spacer 5 is arranged on the mutually opposite sides of the electrode pieces 3, 4, and the electrode pieces 3, 4 rest on this spacer 5. The spacer 5 surrounds an arc gap which is formed between the two electrode pieces 3, 4. The first electrode piece 3 has a projecting plateau 6 in order to guide an arc. The second electrode piece 4 is electrically conductively connected to an electrode plate 7. The electrode plate 7 covers a recess in the second electrode piece 4. A gas generator 8 which can be initiated thermally is arranged in the recess in the second electrode piece 4. The gas generator 8 is pressed against the electrode plate 7 by a spring element 9.

Bridging the arc gap, an impedance element 10 makes electrically conductive contact with the first and the second electrode pieces 3, 4. The impedance element 10 is, for example, a pure resistance. The response behavior of the arc gap can be controlled by means of the impedance element.

In order to allow the disconnecting switch device 2 to be used in outdoor conditions, it has an electrically insulating housing 10. The electrically insulating housing 10 is formed from two shells. The outer surface of the electrically insulating housing 10 is formed by a first shell 12.

The first shell 12 is essentially in the form of a cup. The first shell 12 is provided with a recess, into which the first electrode piece 3 is inserted flush. In order to limit the introduction of the first electrode piece 3 into the recess, and to achieve a sealing effect, the first electrode piece 3 is provided with a circumferential shoulder, which is supported on the base of the first shell 12.

The recess in the first shell is surrounded by a projecting attachment 13. When choosing a dimensionally stable insulating material, the attachment 13 is suitable for protecting a contact-making area of the first electrode piece 3. In the present exemplary embodiment, a threaded hole is provided for making contact. When the threaded hole is screwed onto a threaded bolt, the attachment 13 can, for example, be pressed against a flat surface, so as to prevent direct access to the contact-making area of the first electrode piece 3. With a correspondingly elastic embodiment of the first shell 12, a sealing effect can be achieved if required on the flat surface by the attachment 13.

The longitudinal axes can be aligned with respect to one another by appropriate matching of the dimensions of the recess in the first shell 12 and of the first electrode piece 3, when the first electrode piece 3 is inserted into the recess. The further components which are connected indirectly or directly to the first electrode piece 3, for example the spacer 5, impedance element 10, second electrode piece 4, etc., are also aligned with the alignment of the first electrode piece 3 and the first shell 12 with respect to one another.

This results in an approximately annular area in the interior of the first shell 12, into which a second shell 14 can be introduced. In contrast to the first shell 12, the second shell 14 makes contact both with the first electrode piece 3 and with the second electrode piece 4.

The second shell 14 is introduced into the annular area in a liquid or highly viscous state. An electrical insulating material can be used as the material. One suitable insulating material is, for example, a polyurethane. The impedance element 10 is embedded within the second shell. The assemblies of the disconnecting switch device are integrally joined to one another.

In the contact area of the second electrode piece 4 (in this case a threaded bolt), a surface of the second shell 14 is accessible. The first shell 12 is separated from the second electrode piece 4 by the second shell 14. The second shell 14 ends substantially flush with the first shell 12.

When the disconnecting switch device 2 has been assembled, the first shell 12 extends like a bell over the second shell 14.

During a dissipation process during operation, that is to say when the surge arrester with which the disconnecting switch device 2 is associated has no fault, there is a dissipation current flow via the electrode pieces 3, 4 and an arc of relatively low intensity is struck in the arc gap. At the end of the dissipation process, the arc is quenched by varistors in the surge arrester.

In the event of a fault in the surge arrester, a current likewise flows via the current path, which comprises the electrode pieces 3, 4 and an arc gap. However, an arc burns for longer and more strongly in the arc gap than in the case of a dissipation process of a fault-free surge arrester. A large amount of thermal energy is therefore also released. This energy initiates the gas generator 8, which suddenly generates a large amount of gas. The pressure cannot escape directly because the housing 11 is closed around the arc gap, thus forcing the electrode pieces 3, 4 apart from one another. The disconnecting switch device 2 has tripped. In the process, the arc is quenched.

The invention claimed is:

1. A disconnecting switch device, comprising:

a first electrode piece and a second electrode piece, said first and second electrode pieces being movably disposed relative to one another for disconnecting a current path therethrough;

an electrically insulating housing at least partially surrounding said first and second electrode pieces;

said housing including a first shell and a second shell, said first shell sheathing said second shell and protecting said second shell against external influences: and wherein said first electrode piece is disposed to close off a recess formed in said first shell.

2. The disconnecting switch device according to claim 1, wherein said first shell forms a permanent shuttering for said second shell.

3. The disconnecting switch device according to claim 1, which comprises a projecting attachment on said first shell surrounding said recess.

4. The disconnecting switch device according to claim 1, wherein said first electrode piece and said second electrode piece are aligned coaxially with respect to a longitudinal axis of the disconnecting switch device, said first electrode piece has a first end adjacent said first shell, and said second electrode piece has a second end adjacent said second shell, with respect to the longitudinal axis.

5. The disconnecting switch device according to claim 1, wherein the current path has an arc gap.

6. The disconnecting switch device according to claim 1, wherein said second shell is formed of polyurethane.

7. The disconnecting switch device according to claim 1, wherein said first shell is formed of a UV-stable insulating material.

8. A method of producing a disconnecting switch device, the method which comprises:

at least partially inserting first and a second electrode pieces of a disconnecting switch device into a dimensionally stable first shell, serving as a permanent shuttering, of an electrically insulating housing of the disconnecting switch device;

introducing a second shell of the electrically insulating housing in a dimensionally flexible condition into said first shell, wherein the dimensionally flexible shell converts into a dimensionally stable body within the first shell; and embedding an impedance element in the second shell, the impedance element making electrical contact with the first electrode piece and with the second electrode piece.

9. The method according to claim 8, which comprises inserting the first electrode piece in sealing engagement into a recess formed in the first shell.

10. The method according to claim 9, wherein the inserting step comprises substantially aligning a longitudinal axis of the first electrode piece and a longitudinal axis of the first shell to correspond approximately relative to one another.

11. A disconnecting switch device, comprising:

a first electrode piece and a second electrode piece, said first and second electrode pieces being movably disposed relative to one another for disconnecting a current path therethrough;

an electrically insulating housing at least partially surrounding said first and second electrode pieces;

said housing including a first shell and a second shell, said first shell sheathing said second shell and protecting said second shell against external influences; and wherein said first electrode piece and said second electrode piece are aligned coaxially with respect to a longitudinal axis of the disconnecting switch device, said first electrode piece has a first end adjacent said first shell, and said second electrode piece has a second end adjacent said second shell, with respect to the longitudinal axis.

* * * * *